US008607602B1

(12) United States Patent
Okoye et al.

(10) Patent No.: US 8,607,602 B1
(45) Date of Patent: Dec. 17, 2013

(54) PASSENGER PORTABLE SAFETY BRAKE

(76) Inventors: Godwin Okoye, Albuquerque, NM (US); Mathias Okoye, Albuquerque, NM (US)

( * ) Notice: Subject to any disclaimer, the term of this patent is extended or adjusted under 35 U.S.C. 154(b) by 0 days.

(21) Appl. No.: 12/878,361

(22) Filed: Sep. 9, 2010

(51) Int. Cl.
*G05G 5/00* (2006.01)

(52) U.S. Cl.
USPC ..... 70/201; 70/199; 70/204; 70/237

(58) Field of Classification Search
USPC ..... 70/199, 201, 202, 237, 198, 204, 238, 70/254
See application file for complete search history.

(56) References Cited

U.S. PATENT DOCUMENTS

| | | | | | |
|---|---|---|---|---|---|
| 3,719,063 | A * | 3/1973 | Fouces et al. | ..... | 70/202 |
| 5,055,823 | A * | 10/1991 | Fuller | ..... | 70/209 |
| 5,454,242 | A * | 10/1995 | Su | ..... | 70/209 |
| 5,718,133 | A * | 2/1998 | Chen et al. | ..... | 70/209 |
| 5,911,765 | A * | 6/1999 | DaSilva | ..... | 70/202 |
| 6,089,055 | A * | 7/2000 | Vito | ..... | 70/202 |
| 6,298,696 | B2 * | 10/2001 | Vito | ..... | 70/202 |
| 6,349,580 | B1 * | 2/2002 | Kuo | ..... | 70/209 |
| 6,575,002 | B1 * | 6/2003 | Hsu | ..... | 70/202 |
| 6,694,785 | B1 * | 2/2004 | Hsieh | ..... | 70/209 |
| 6,766,674 | B2 * | 7/2004 | Simon | ..... | 70/202 |
| 6,792,780 | B1 * | 9/2004 | De Lucia | ..... | 70/202 |
| 6,976,374 | B1 * | 12/2005 | Dougherty | ..... | 70/202 |
| RE39,248 | E * | 8/2006 | Vito | ..... | 70/202 |
| 7,251,969 | B2 * | 8/2007 | Simon | ..... | 70/202 |
| 7,301,443 | B2 * | 11/2007 | Yu | ..... | 70/252 |
| 7,412,859 | B2 * | 8/2008 | Lycoudis | ..... | 70/202 |
| 7,628,046 | B2 * | 12/2009 | Su | ..... | 70/209 |
| 2008/0053171 | A1 * | 3/2008 | Simon | ..... | 70/202 |
| 2009/0071206 | A1 * | 3/2009 | Yu | ..... | 70/237 |

* cited by examiner

*Primary Examiner* — Christopher Boswell
(74) *Attorney, Agent, or Firm* — Peacock Myers, P.C.; Janeen Vilven

(57) ABSTRACT

Passenger portable safety brake, a safety devise for passenger to control the speed or stop a car driven by a student driver. The passenger portable safety brake includes a handle, elongated tube and U-shaped tip with a latch. This device is designed to easily and temporarily attached to the car brake and controlled by the passenger, driving instructor, parents or any one that is helping the student driver with on the road instruction.

3 Claims, 1 Drawing Sheet

PASSENGER PORTABLE SAFETY BRAKE

BACKGROUND OF THE INVENTION

1. Field of the Invention

The present invention relates to speed control devices and particularly pertains to a new passenger portable safety devise to stop the vehicle driven by a student driver.

Graduated Driving licensing laws requires that in addition to the driving school training that parents/guardians participate in fifty (50) hours or more of on-road instruction with their teens. As a driving school instructor, I have discovered that unfortunately, most of the parents feel scared and unwilling to help teach their teens with the family car. This leaves most of the students in a very difficult situation to honestly complete and log in their 50 hours. These parents' fears could be justified because unlike the driving school instructors, they have no way of stopping the vehicles in case of emergency or possible collusion. Prior to becoming a certified driving instructor, I once took my sister in-law out in my car to teach her how to drive. Down the road, for some unknown reason, she was overtaken and completely frozen by fear as she pressed the gas pedal all the way to the floor. She loses control of the car and swerves. All my attempts to remedy this eminent disaster were abortive. As she veered off her course, went over the media and across the opposite lane, I attempted to grab the steering from her and redirect the car, but her resistance was too hard to overcome. Since I had no way to stop the vehicle we ended up in a near fatal accident. We hear and read about similar cases all around the country. Fortunately, being a driving aid instructor with passenger brake has helped me avoid multiple close calls and near death crashes with my students. However, this is not the same situation with the family vehicles since they do not have passenger brake and most of them could not afford to pay over $500.00 to buy, drill their cars and install any seemingly permanent/cumbersome brake like the professional schools just for a short while they are needed.

My desire to do something about this situation led me to discuss this matter with my father, Mr. Matthias Okoye (co-inventor). He and I put some ideas together and developed this portable hand-held passenger safety break. My extensive patent search and market research has revealed that no such or similar invention and product is available. The only close art, Osbrake safety brake is discussed below.

2. Description of the Prior Art

The objective of any preliminary patentability search is to discover issued "prior art" United States patents which are similar to the invention being investigated so that a judgment can be made as to the potential for obtaining a patent protection. When possible, a patentability search is directed to both utility and design features of an invention. A utility patent protects the function (i.e., how it works and how it is used). Patent can be issued to any person who invents a new, useful and non obvious (1) process, (2) machine, (3) manufactured article, (4) composition of matter, or (5) any new and useful improvement to any of these types of inventions). Design patent protests the overall appearance or how the invention looks. It can be granted for a new, original and ornamental design for an article of manufacture.

The use of speed control devices is known in the prior art. More specifically, speed control devices heretofore devised and utilized are known to consist basically of familiar, expected and obvious structural configurations. The extensive search of the US patent website revealed neither any known patented prior art or patent pending art. The following categories and subs were searched with no apparent findings:

Class 280, land vehicle, subs 748-753 (passenger safety); Class 188, brakes. sub 371-377; 190.01 (operators cab); 187.01 dealing with safety means to a person at a location where operation of vehicle is controlled; Class 296 (land vehicles bodies and top, all subs including (1.04, 1.01) safety device; all class and subs of 180, motor vehicles; 160 (flexible or portable closures, partitions or panel); subs 1.01 (safety device); 190.03 (operators protection in a cab structure); class 192, sub 3.23, 3.24 (alternative brake and clutch); brake supports 188/208, brake 188/2R+, 79.57 manually operated; panic braking DIG1.

However, further market research revealed a passenger safety brake devise by Osbrake, Inc. (www.osbrake.com). The Osbrake devise (not shown) is predominantly used by the professional driving schools and not by the parents.

While this Osbrake device fulfils it's respective, particular objectives and requirement, it does not disclose a new speed control devise similar to the present invention. It minors the regular automobile brake, the only difference being that it is installed on the passenger side.

The present invention, Passenger Portable Safety Brake consists of a handle, an elongated middle section and preferably a U-shaped tip with a latch. The whole device is portable, controlled by hand and needs no installation.

In these respects, the passenger portable safety brake according to the present invention substantially departs from the conventional concepts and designs of the above mentioned Osbrake which has the inscriptions "Patent Pending" and in so doing the passenger portable safety brake provides a new apparatus primarily developed for the purpose of slowing down or stopping a car driven by a student driver.

In making the above described analysis, I have compared and evaluated the differences between the present invention, its application and design with any known similar art, patented or not. The courts have held that an invention may be patentable, even if the invention comprises a combination of features already known and shown in the prior art, provided that the combination itself is not obvious. More specifically, the invention must be considered as "whole" to include each and every individual structural component, implied or described methods of assembly, process of manufacture, chemical composition, and/or functional usage. Since I have disclosed a new and unobvious use for my invention, as well as a description of structural elements which are arranged or otherwise differ from what is shown in my research, I have concluded that utility patent protection could be potentially obtained for this invention.

SEARCH LIMITATIONS

While reasonable effort has been made to assure the reliability of the present patentability search, no such search can be absolutely conclusive of patentability. Furthermore, a search is limited by human error factor, the possibility of missing patent references, and the considerations of time and expense. Usually, any new patents issued after the date of search, or not currently on file at the time of the search will certainly not be detected. Even in spite of these factors, these searches are generally reliable and often reveal prior art that establishes the non patentability of an invention. That does not seem to be the case with this search. In the present case, continuing a more comprehensive search is not recommended because it is believed that present search has extended to the point of diminishing returns. Foreign search was also done with no outcome.

SUMMARY OF THE INVENTION

In view of the foregoing disadvantages inherent in the known type of devices for the passenger to stop a car that are now present in the prior art, the present invention provides a new speed control device wherein the same can be utilized by the passenger or parents for the safety purpose of stopping or slowing a car driven by a student driver.

The general purpose of the present invention which will be later disused in more detail, is to provide a new brake device apparatus and method which has many advantages of the vehicular brake mentioned heretofore and many novel features that result in a new passenger brake device which is not anticipated, rendered obvious, suggested, or even implied by any known prior art brake devices, either alone or in any combination thereof.

In order to accomplish this, the present invention generally comprises of three main sections; a handle to be gripped by the passenger, the mid section comprising of elongated tube and preferably a U-shaped tip with a latch.

This above outline has thus made rather broadly the more important features of the invention in order that the detailed description that follows thereof may be better understood, and in order that the present contribution to the art may be better appreciated. There are additional features of the invention that will be described herein after and which will form the subject matter of the claims appended hereto.

In the is respect, before explaining at least one embodiment of the invention in detail, it is to be understood that the invention is not limited in its application to the details of the construction and to the arrangement of the components set forth in the following description or illustrated in the drawings. The invention is capable of being of other embodiments and of being practiced, used, or carried out in various ways, forms and shapes. Also it is to be understood that the phraseology and terminology used herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and use scope of the present invention.

Further, the purpose of the foregoing abstract is to enable the US. Patent and Trademark Office and the public generally and especially the scientist, engineers and practitioners in the art who are not familiar with the patent or legal terms or phraseology to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new passenger portable safety brake device apparatus and method which has many of the advantages of the vehicular motion stopping or slowing device mentioned heretofore and many novel features that result in a new passenger portable safety brake device which is not anticipated, rendered obvious, suggested, or even implied by the any of the prior art of land vehicle speed control devices, either alone or in any combination thereof.

It is another object of the present invention to provide a new passenger portable safety brake device which may be easily and efficiently manufactured and marketed.

It is a further object of the present invention to provide a new passenger portable safety brake device which is of a durable and reliable construction using already existing technology.

An even further object of the present invention is to provide a new passenger portable safety brake device which is susceptible of a low cost of manufacture with regard to both material and labor, and which accordingly is then susceptible of low prices sale to the consuming public, thereby making such passenger portable safety brake device economically available to the buying public.

Still yet another object of the present invention is to provide a new passenger portable safety brake device which provides in the apparatus and methods of the prior art some of the advantages thereof, while simultaneously overcoming some of the disadvantages normally associated therewith.

Still another object of the present invention is to provide a new passenger portable safety brake device to enable the trainer to stop the student driver from eminent accident, possible injury, and damage to property and even possible death.

It is another object of the present invention to provide a new passenger portable safety brake device which will partially or totally eliminate the fears of parent and their reluctance to fulfill the legal requirement of helping their teens complete their fifty (50) hours of the on the road of driving instructions.

Yet is another object of the present invention to provide a new passenger portable safety brake device which includes a handle, an elongated tube, a U-shaped/forked/similar shaped tip with latch that opens and closes and capable of being secured and locked around the top metal part right above driver's brake pedal.

It is also another object of this present invention to provide a new safety, easy to use, portable, removable, installation-free device with the handle being held and controlled by the passenger thereby giving the passenger the ability to stop or slow the speed of land vehicle or similar vehicles by pushing down on the handle.

These, together with other objects of the invention, along with the safety features of the novelty which characterizes the invention, are pointed with particularity in the claims annexed to and forming a part of this disclosure. For a better understanding of the invention, its simple operating advantages and the specific objects attained by its uses, reference should be made to the accompanying drawings and descriptive matter in which there are illustrated preferred embodiment of the invention.

BRIEF DESCRIPTION OF THE DRAWINGS

The invention will be better understood and the objects other than those set forth above will become apparent when consideration is given to the following detailed description thereof. Such description makes reference to the annexed drawings wherein.

DESCRIPTION OF THE PREFERRED EMBODIMENT

Figure 1:
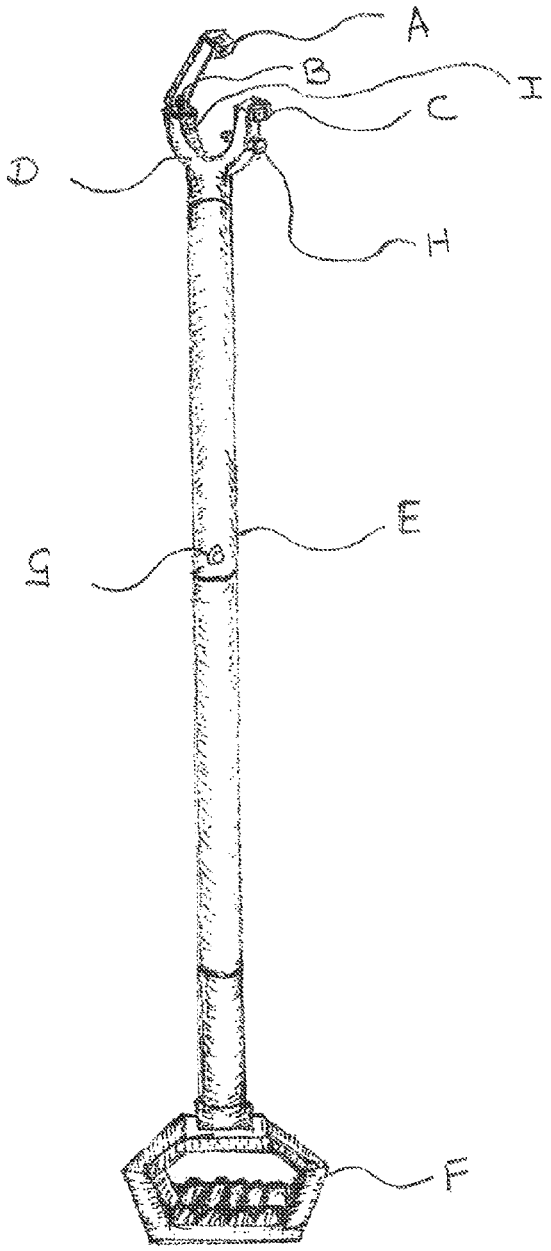
FIG. 1 is a schematic perspective view (with latch open) of new passenger portable safety brake device according to the present invention.
Figure 2:
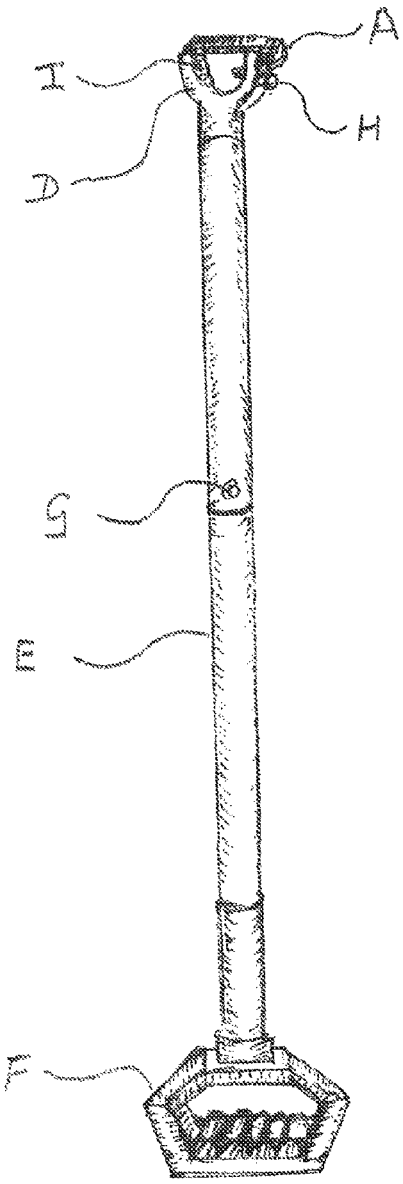
FIG. 2 is a schematic perspective view (with latch closed) of new passenger portable safety brake device according to the present invention.

With reference now to the drawings, and in particular to FIGS. 1 and 2, a new passenger portable safety brake device embodying the principle and concepts of the present invention will be described.

As best illustrated in FIGS. 1 and 2, the passenger portable safety brake device generally comprises of a locking mechanism A with a pivot point B. The locking mechanism is located on the left side of the two symmetrical curved end of the device D. The locking mechanism pivots up and down to open or to close. To lock or secure the device, simply push down the locking mechanism A and secure it to the latch C which is situated on the tip of the aforementioned right symmetrical curved end of the device D. The tips of both the left and the right curvature of D form a 180 degree grooved angle. Right below the latch C is an optional screw H to additionally secure the end of the device D right below the flat surface of the brake pedal by the pedal post if needed. The symmetric curved tip of the device D is then connected to an elongated tube or pipe E.

The other end of the elongated tube or pipe E is attached to a handle F. The elongated tube or pipe could be fitted with extension button G (optional) to enable possible extension or retraction to the length of the invention. The whole device could possibly comprise of one solid material or the three main parts: D, E, F which are then attached to one another by screwing one into the other to form the whole apparatus as shown in FIGS. 1 and 2. The size of the invention and its components are not mentioned but will generally be about 35 ins to 40 ins. in length, curved or straight to conform to the make and model of different vehicles. The inner lining of the tip I could be fitted with yet another optional anti sliding rubber material to ensure that the passenger portable safety brake device is adequately secured to the vehicular brake pedal post without sliding up and down while in use. A test of the prototype fabricated by the inventor himself has proven the device to be very effective.

DIRECTIONS

To Use:

One of greatest features of the present invention, the passenger portable safety brake device is that it is so easy to use. To use, simply unlock the latch A by pulling it up and away from the latch lock C, disengaging A from C. Then with the handle F towards the passenger/passenger seat, attach the U-shaped tip D of the passenger portable safety brake device around the rod directly above the vehicular brake (Not shown) then lock A and C by pressing them together directly behind the vehicular brake rod above the brake pedal or a little further up the pedal as necessary. Then tighten the optional screw H with your hand if necessary. The passenger can now easily control the vehicular brake by simply pressing down on the handle F as needed.

As to a further discussion of the manner of usage and operation of the present invention, the same should be apparent from the above description. Accordingly, no further discussion relating to the manner of usage and operation will be necessary.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction, operation shown and described, and accordingly, all suitable modifications and equivalents be resorted to, falling within the scope of the invention.

We claim:

1. A hand held brake device to stop or slow an automobile comprising:

a u-shaped tip having a first side with a first end and a second side with a second end wherein the first side and the second side are connected by an arch, the u-shaped tip comprising a latch on the tip of the first end and a tip of the second end of the u-shaped tip comprising a latch locking component;

a cylindrical middle section wherein the first end and the second end of the u-shaped tip connect with the cylindrical middle section through the arch; and a top handle;

wherein the u-shaped tip, the cylindrical middle section, and the top handle firmly attach to each other to form one solid apparatus wherein the u-shaped tip is not wider than the top handle; and wherein the tip end of the first side of the u-shaped tip is connected to the tip end of the second side of the u-shaped tip by the latch wherein the latch is perpendicular to the cylindrical middle section when the latch is in the closed position and the u-shaped tip terminates at the latch.

2. The hand held brake device of claim 1 wherein the u-shaped tip is capable of being firmly secured to a brake pedal of a car the handle enabling a moving car to be stopped or slowed by pushing down on the handle and subsequently engaging the brake.

3. The device of claim 1 further comprising an extendable cylindrical section.

* * * * *